US011708670B2

(12) United States Patent
Motz et al.

(10) Patent No.: US 11,708,670 B2
(45) Date of Patent: Jul. 25, 2023

(54) METHOD AND APPARATUS FOR INCORPORATING ALREADY USED AND EXTRACTED INFILL INTO THE SUBSURFACE OF A NEWLY INSTALLED FIELD

(71) Applicant: Technology Licensing Corp., Cincinnati, OH (US)

(72) Inventors: Joseph E Motz, Cincinnasti, OH (US); Mark A Heinlein, Cincinnati, OH (US)

(73) Assignee: Technology Licensing Corp., Cincinnati, OH (US)

( * ) Notice: Subject to any disclaimer, the term of this patent is extended or adjusted under 35 U.S.C. 154(b) by 1191 days.

(21) Appl. No.: 16/281,358

(22) Filed: Feb. 21, 2019

(65) Prior Publication Data

US 2019/0186081 A1 Jun. 20, 2019

Related U.S. Application Data

(63) Continuation of application No. PCT/US2017/052779, filed on Sep. 21, 2017.

(Continued)

(51) Int. Cl.
*E01C 13/08* (2006.01)
*E01C 3/00* (2006.01)

(Continued)

(52) U.S. Cl.
CPC ..... *E01C 13/08* (2013.01); *E01C 3/003* (2013.01); *E01C 19/02* (2013.01); *E01C 19/264* (2013.01); *E01C 19/42* (2013.01); *E01C 23/12* (2013.01)

(58) Field of Classification Search
CPC ..... E01C 13/08; E01C 19/42; E01C 3/003; E01C 19/02
See application file for complete search history.

(56) References Cited

U.S. PATENT DOCUMENTS 5,014,462 A 5/1991 Malmgren et al.
2002/0145295 A1 10/2002 Frank et al.

(Continued)

FOREIGN PATENT DOCUMENTS

EP 2387875 11/2011
NL 1039532 * 10/2012 ..... E01C 13/08

OTHER PUBLICATIONS

United States Patent and Trademark Office, Notice of Transmittal Of and International Search Report and Written Opinion for PCT/US2017/52779, dated Dec. 11, 2017 (15 pgs.).

*Primary Examiner* — Michael D Dennis
(74) *Attorney, Agent, or Firm* — Wood Herron & Evans LLP

(57) ABSTRACT

Particulate infill from a worn down infilled artificial turf, particularly a sand/rubber mixture which includes crumb rubber from vehicle tires, is extracted from a prior field and then thereafter incorporated into the top surface of the compacted base at the same site, thereby to assure better drainage conditions in the compacted base for the subsequently installed field. The extracted and incorporated infill helps to maintain open drainage channels throughout the top of the compacted base, particularly in areas where limestone is prevalent. Otherwise, the limestone "fines" are susceptible to compacting and creating a cement-like crust at the top of the base. An existing infill extractor/collector device is modified to operate in a second mode, so that instead of merely performing the conventional bagging of the already-used infill, the already-used infill is laterally diverted back on to the base at the same site, and thereafter, distributed and tilled into the base. By incorporating the extracted infill into the base of the new field, the need to bag, remove, and dispose of the used infill is eliminated, along with the time and costs associated therewith, while at the same time (Continued)

improving the drainage of the new field. Two structures for diverting the collected infill are disclosed.

4 Claims, 6 Drawing Sheets

Related U.S. Application Data

(60) Provisional application No. 62/397,652, filed on Sep. 21, 2016.

(51) Int. Cl.

| | |
|---|---|
| ***E01C 23/12*** | (2006.01) |
| ***E01C 19/26*** | (2006.01) |
| ***E01C 19/02*** | (2006.01) |
| ***E01C 19/42*** | (2006.01) |

(56) References Cited

U.S. PATENT DOCUMENTS

| | | | | |
|---|---|---|---|---|
| 2013/0202396 | A1* | 8/2013 | Motz | E01C 19/522 414/502 |
| 2013/0280445 | A1* | 10/2013 | McAnany | E01C 13/08 428/17 |
| 2014/0305669 | A1 | 10/2014 | Owegeser | |
| 2015/0247293 | A1* | 9/2015 | Allingham | D04H 1/54 428/17 |
| 2017/0232878 | A1* | 8/2017 | King | E01C 23/00 414/502 |

* cited by examiner

METHOD AND APPARATUS FOR INCORPORATING ALREADY USED AND EXTRACTED INFILL INTO THE SUBSURFACE OF A NEWLY INSTALLED FIELD

This application claims priority to PCT Application Serial No. PCT/US2017/052779, filed on Sep. 21, 2017, which claims priority to U.S. Provisional Application No. 62/397,652, filed on Sep. 21, 2016, each of which is expressly incorporated by reference herein, in its entirety.

BACKGROUND OF THE INVENTION

Infilled artificial turf surfaces have become increasingly popular in recent years, particularly as a playing surface for athletic fields used for football, soccer, lacrosse, field hockey, etc. Such infilled artificial turfs are disclosed in, for instance, U.S. Pat. No. 6,551,689, which is expressly incorporated by reference herein, in its entirety.

Generally, an infilled artificial turf comprises a subsurface drainage system, with various drainage components located within a compacted base. The compacted base usually includes a soil sub-base, a lower layer of stone or gravel, and a layer of finer gravel located above the stone. This substructure provides a level and compact base, or foundation, to support the athletic field located thereabove.

The actual artificial turf components comprise a horizontally oriented backing often called a "primary," and grass-like fibers extending upwardly from the primary, with a particulate infill material located within and among the grass-like fibers to support the fibers and help to maintain a grass-like playing surface. Infill materials may comprise sand particles, coated sand, resilient particles, or a mixture of these various types of particles. One commonly used resilient particulate includes ambiently or cryogenically ground crumb rubber, which is produced from used automotive or truck tires. With a sand/rubber mixture, the sand provides ballast and weight for holding down the turf component on the base, and also provides a desired degree of firmness, while the rubber particles provide a desired degree of resiliency and shock absorption.

Despite the relatively wide variety of possible infill materials, for practical and economic reasons, most infilled artificial turf athletic fields have used an infill comprising a mixture of sand and crumb rubber. For these types of fields, the total weight of the infill on a particular field, such as a normal U.S. sized football, is in the range of about 250-750 thousand pounds. This presents an enormous amount of infill for the owner to dispose of when replacing the field, and such disposal presents correspondingly significant logistics and practical problems. More particularly, because these infills include crumb rubber, and many jurisdictions now wish to discontinue any further use of crumb rubber as an infill, due to environmental concerns, there are limits on what the owner or the contractor is able to do with an already-used infill from a worn-out infilled artificial turf.

For a significant number of institutions which have installed and used this type of infilled artificial turf field, including professional teams, colleges and universities, and high schools, the first generation, or originally installed, infilled artificial turf has now worn down and/or needs to be replaced, or has outlasted its warranty. Because of the continuing popularity of infilled artificial turf fields, the owners of such worn down artificial turfs often choose to replace the existing and worn infilled artificial turf field with a new infilled artificial turf field. As a result of this situation, these athletic field owners have a need to optimize the efficiency and the cost-effectiveness in removing an existing in-place infilled artificial turf and installing a new infilled artificial turf. The present applicant has developed a line of equipment that helps such owners in meeting that need. This equipment is shown and described in PCT Patent Application No. PCT/US2014/025514 (the "PCT '514 application"), entitled "Apparatus For Infill Extraction And Collection," which is expressly incorporated by reference herein, in its entirety. This equipment is identified via the trade name Turf Reclamation Services, as shown at www.recyclingartificialturf.com.

More particularly, this equipment includes an infill extractor/collector device which has achieved significant success in removing an existing infilled artificial turf field, and in extracting and reclaiming the already-used infill from the removed turf. As taught in the PCT '514 application, the extracted and reclaimed infill can be reused as the infill for the next field located at the same site, with or without on-site cleaning prior to re-use. Alternatively, it can be sent offsite for reuse elsewhere, with or without cleaning before pre-use. As another alternative, although not preferred, the already-used infill may simply be discarded in a landfill.

Regardless, because of the significant volume and weight of the extracted and reclaimed infill, i.e., as noted above, over 250,000 pounds, it is important for the field owner to make a determination as to what to do with the existing infill before the existing turf is removed. Among other reasons, it is difficult to dispose of such a large volume of extracted infill, particularly if the infill includes crumb rubber particles from vehicle tires. In some jurisdictions disposal in a landfill is not an acceptable or available option, for a number of reasons. In other situations the field owner may wish to reuse the extracted infill in the new field. Under this scenario it is best to first clean the already-used infill. Although such cleaning is technically possible, it can be prohibitively expensive. Thus, such cleaning of the reclaimed infill prior to reuse often does not occur. In still other situations the field owner may choose to use a different type of infill with the new field, rather than the originally used sand/rubber mixture.

For all of these reasons there remains a need to extract and collect the particulate infill from an already-used infilled artificial turf, and to identify a proper way to dispose of or repurpose the already-used infill that has been extracted and collected. In some cases, the already-used infill may represent the best particulate infill for reuse in the new field, at the same site. In other cases, particularly if the field owner wishes to install a new infilled artificial turf with a different type of infill, perhaps a newer type of infill, then the need to bag and transport the extracted infill to another site, whether for reuse or subsequent disposal, may represent an unreasonable expense.

As noted above, the synthetic backing of an infilled artificial turf resides on a compacted base. The top surface of the base often comprises a gravel particulate referred to as "fines." Typically, for practical reasons the base also comprises materials that are relatively convenient to obtain in the particular geographical area where the field is located. In many parts of the continental United States limestone is prevalent and/or readily accessible. This often means that the "fines" within the particulate at the top of the base will include limestone.

Unfortunately, limestone fines have a tendency to consolidate and compact over time, and in some situations become cement-like in nature. This can create an impenetratable crust on the topmost surface of the base, of about 2-3 inches in depth. This crust is not necessarily difficult to break up, when it is time to install the new field. However, the problem is that simply breaking up the crust serves as merely a temporary fix. That is, shortly thereafter the topmost surface of the base may again eventually reach the same condition, namely, that of an impenetratable crust which can inhibit the normal water drainage of the field.

With an in-place field, when this type of crusting occurs at the top of the compacted base, and the drainage becomes impaired, the only way to fix the problem is to cut through the artificial turf residing thereabove. In other words, the synthetic turf must be cut to allow access to the problematic surface located therebelow. Obviously, this requires downtime for the field itself, and it also causes inconvenience and costs associated with repairs. Moreover, because the likelihood of recurrence could be relatively high, the overall burden associated with this downtime and repair work can become significant.

SUMMARY OF THE INVENTION

It is an object of the present invention to decrease the costs associated with installing a new athletic field at the site of an already existing infilled artificial turf field.

It is another object of the present invention to enable a field owner to identify and use the best possible infill material for a newly installed infilled artificial turf, with minimal cost considerations related to the disposal of the already-used infill extracted from a preexisting infilled artificial turf.

It is still another object of the present invention to improve the drainage characteristics of the base used for a newly installed infilled artificial turf, particularly at field sites of a preexisting infilled artificial turf.

It is yet another object of the present invention to achieve these objects while also accommodating the needs of field owners who choose to use a newer or different infill for the new infilled artificial turf, and also those filed owners who choose to bag and haul away the already-used, extracted infill.

It is even yet another object of the present invention to overcome real or potential drainage problems with newly installed infilled artificial turf fields, particularly drainage problems associated with a compacted base that includes limestone fines.

The present invention achieves these objects by modifying an existing infill extractor/collector so as to divert the already-used and extracted infill directly to the top of the compacted base of a preexisting infilled artificial turf, so that the extracted infill can thereafter be incorporated into the top of the compacted base so as to improve the overall drainage characteristics of the artificial turf field to be subsequently installed at the same site. This incorporation of the already-used infill, particularly the crumb rubber, into the top surface of the base mixes resilient particles within the limestone and the sand and helps to maintain vertical infiltration rates, which promotes water drainage and reduces compaction within the upper surface. Preferably, using the infill extractor of the type shown in the PCT '514 application, the extracted infill is placed in windrows next to the strip of turf from which it has just been extracted, and the rows of extracted infill are then spread so as to be evenly distributed onto the compacted base. Thereafter, the base is tilled so as to distribute the extracted infill within the upper 2-3 inches thereof, so as to change the substructure at the top of the base.

The present invention enables an already-used and extracted infill to be repurposed for a newly installed infilled artificial turf, and does so in a manner that eliminates the inconvenience and costs associated with bagging and shipping the extracted infill offsite. More specifically, the present invention eliminates the problems associated with disposing of up to 750,000 pounds of already-used infill. The present invention improves the drainage of the new athletic field, by changing the soil structure at the top of the base so as to maintain vertical infiltration rates. This is particularly true in locations where the "fines" of the base include a significant amount of limestone, and the already-used and extracted infill comprises a mixture of sand and crumb rubber particles, wherein the rubber particles are from reclaimed tires.

According to one aspect of the present invention, the extracted infill is used for the newly installed infilled artificial turf at the same site, except that it is used for a different purpose, namely, that of maintaining acceptable vertical infiltration rates for the compacted base that is located below the newly installed artificial turf.

To practice the present invention in a cost-effective manner on an entire field, while at the same time also accommodating the needs of users who wish to reclaim, clean, or perhaps haul away the preexisting infill, applicant modified its existing infill extractor/collector so as to be operable in either of two modes. The first "conventional mode" is disclosed in the PCT '514 application cited above, whereby infill is collected in bags, i.e. super sacks and then cleaned and/or reused at the same site, or hauled away to a different site. A second mode involves the use of a temporary diverting plate within the frame of the infill collector cart, so as to divert the extracted and collected infill from the turf strip that is being placed back on the base. This lateral diverting of the collected infill occurs via a hole cut in the bottom of the bag. The infill that is extracted, collected, and then conveyed to the cart is then diverted, or redirected, by the diverting plate to create a continuous pile of infill alongside the turf strip that has just been placed back on the base behind the extractor/collector.

There is also an alternate structure for achieving this second mode, by removing the lower first end of the collection auger, and then mounting in its place an outlet or extension to convey the extracted infill directly to the side of the mobile unit.

Those skilled in the art will better understand the present invention by referring to the accompanying drawings, which are described below.

DETAILED DESCRIPTION OF THE INVENTION

Figure 1:
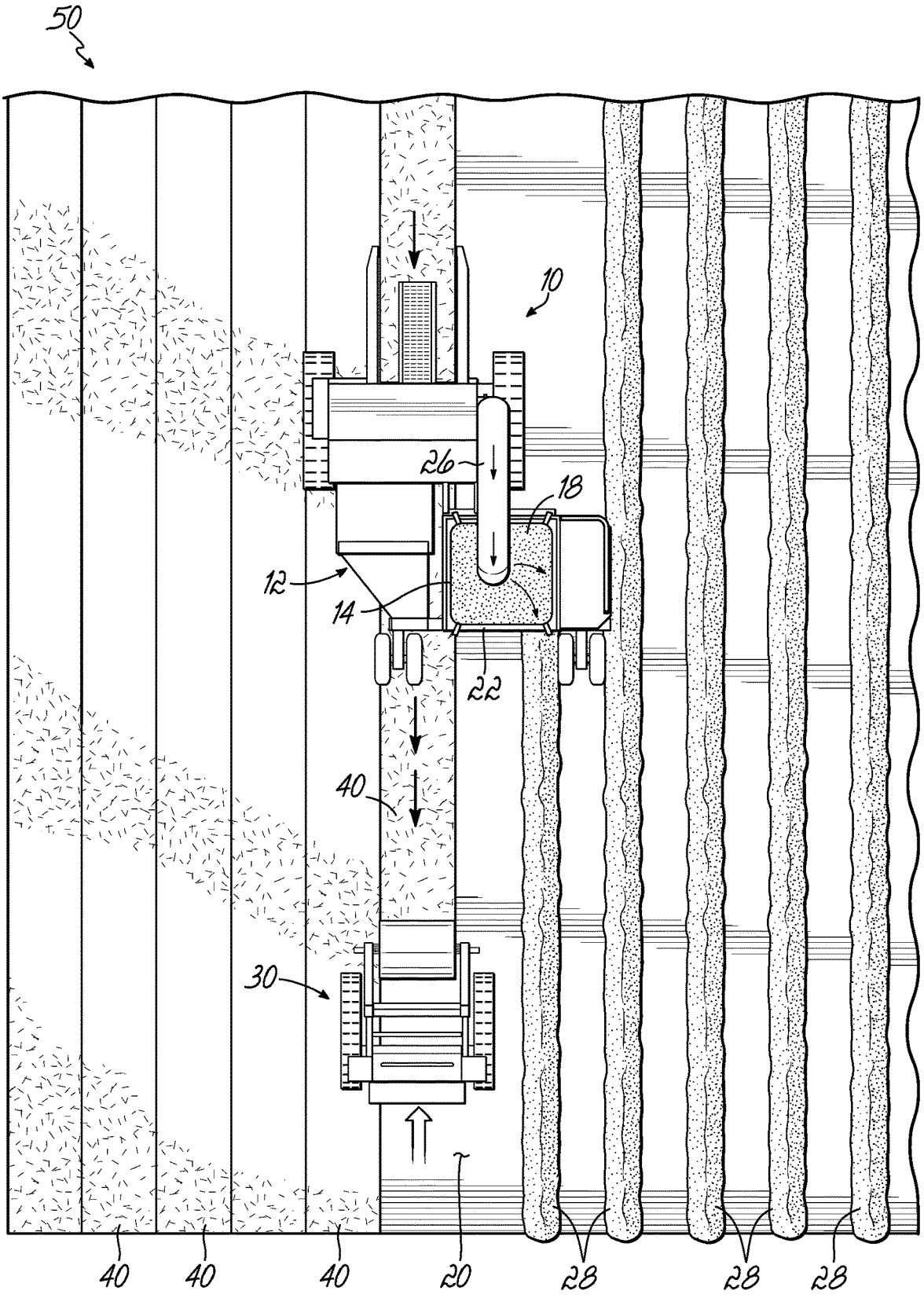
FIG. 1 is a plan view of a field showing an extractor/collector of the PCT '514 application modified to divert the collected infill laterally into a row located next to the strip of turf that is being placed back on the base.

This specification refers to the infill extractor/collector 10 disclosed in the above-described PCT '514 application, and particularly to FIG. 9 thereof, which shows a trailing infill collection cart 12. With the present invention, the bag 14 of the trailing cart 12 is modified so as to be operable in an infill diverting mode, for incorporation of the extracted infill 18 into the compacted base 20. To do this, the bag 14 held within the frame 22 has an open bottom end 14*a*, and the infill 18 is received in the bag 14 as in the conventional collector mode. However, the infill 18 is not collected. Instead, a diverter, e.g. a plate 24 held at an angle that is temporarily mounted within the cart 12, is arranged to hold the bag 14 such that the open bottom end 14*a* is moved laterally from the forward facing direction of the extractor device 10. In use, in this configuration, the infill 18 falls from the auger 26 and into the bag 14. But instead of being collected in the bottom of the bag 14, the infill 18 is instead routed through the bag 14 and redirected in a lateral direction out the open bottom end 14*a*, due to the orientation and the location of the diverter 24. This creates an elongated laterally located pile 28 of infill 18 along the compacted base 20, located next to the travel path of the infill extractor/collector 10. The structure of the PCT '514 application that relates to the present invention is primarily shown in FIGS. 1, 2, 9, 10A, 10B thereof.

Moreover, along with the diverter 24, the bag 14 used in this example includes a hole 14*a* at the bottom, to enable infill 18 to be diverted laterally away from the travel path of the infill extractor/collector 10.

FIG. 1 shows a series of parallel rows/piles 28 of redirected infill residing on a compacted base 20, as a result of the redirecting of infill 18 via the device 10, with an open ended bag 14 and a diverter 24 in place. A turf windup device 30 may follow the extractor/collector 10, to collect, i.e., by rolling up, the strip of turf from which the infill has been extracted. FIG. 1 shows parallel rows 28 of already-used and collected infill 18 in place on the base 20, so that this infill 18 can be readily repurposed for use at the same field site 50, but for use other than as an infill for the new artificial turf. The extracted and collected infill 18 may be deposited onto the base 20 into piles 28 having a fairly low vertical height, i.e., about 2 to 3 feet above the surface in order to reduce the impact of wind during the depositing process.

Figure 2:
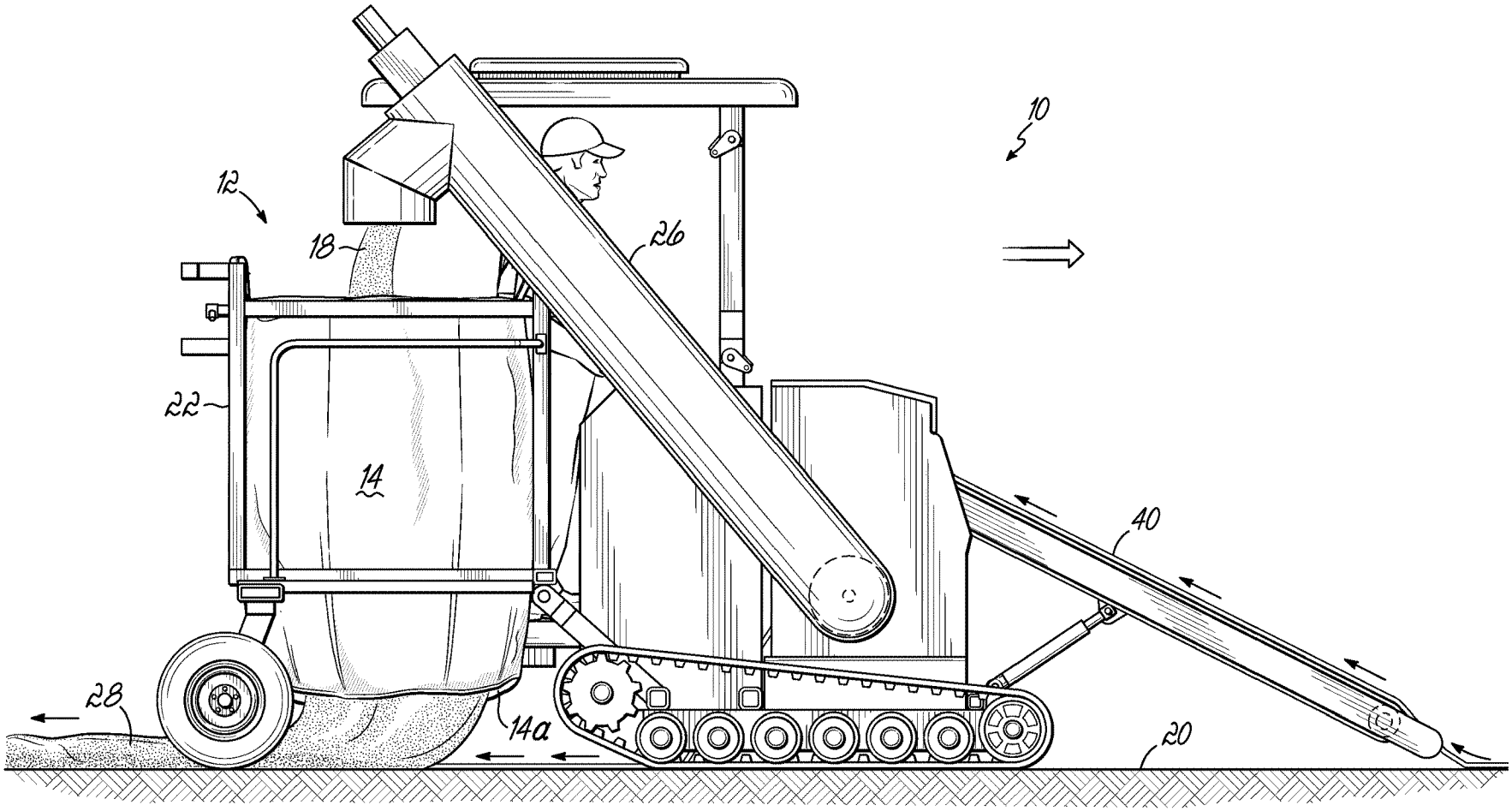
FIG. 2 is a side view of the same structure shown in FIG. 1, with the trailing cart of the extractor/collector equipped with a diverter plate to divert the bottom end of an open ended sack to the side of the travel path.
Figure 3:
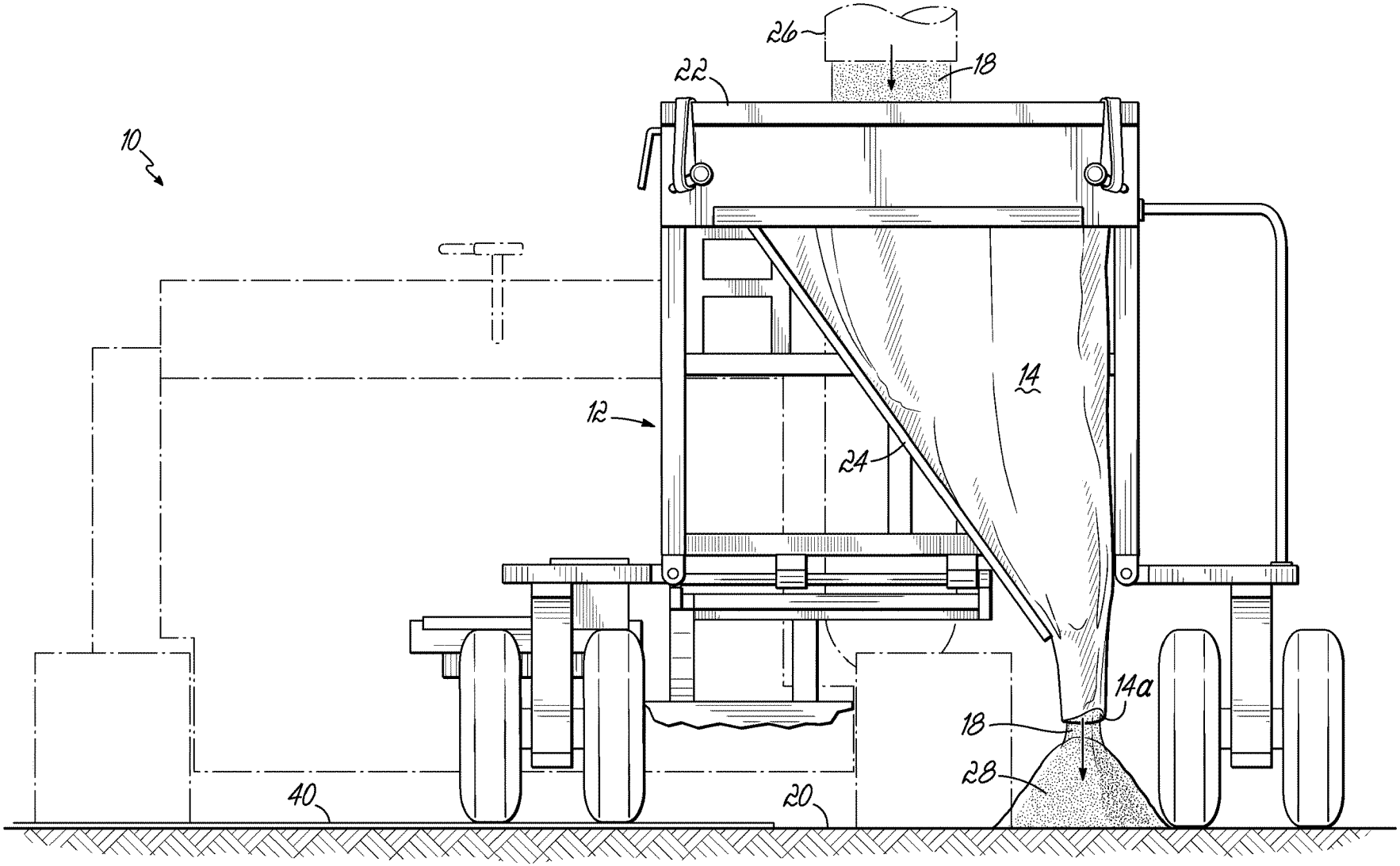
FIG. 3 is a rear view of the same structure shown in FIG. 2.

FIGS. 2 and 3 show side and rear views of the cart 12, respectively, as modified with the diverter plate 24 and the open ended bag 14. Installing a diverter plate 24 and cutting the bag 14 open is the easiest and quickest way to modify this device 10 from its traditional collection mode.

Figure 4:
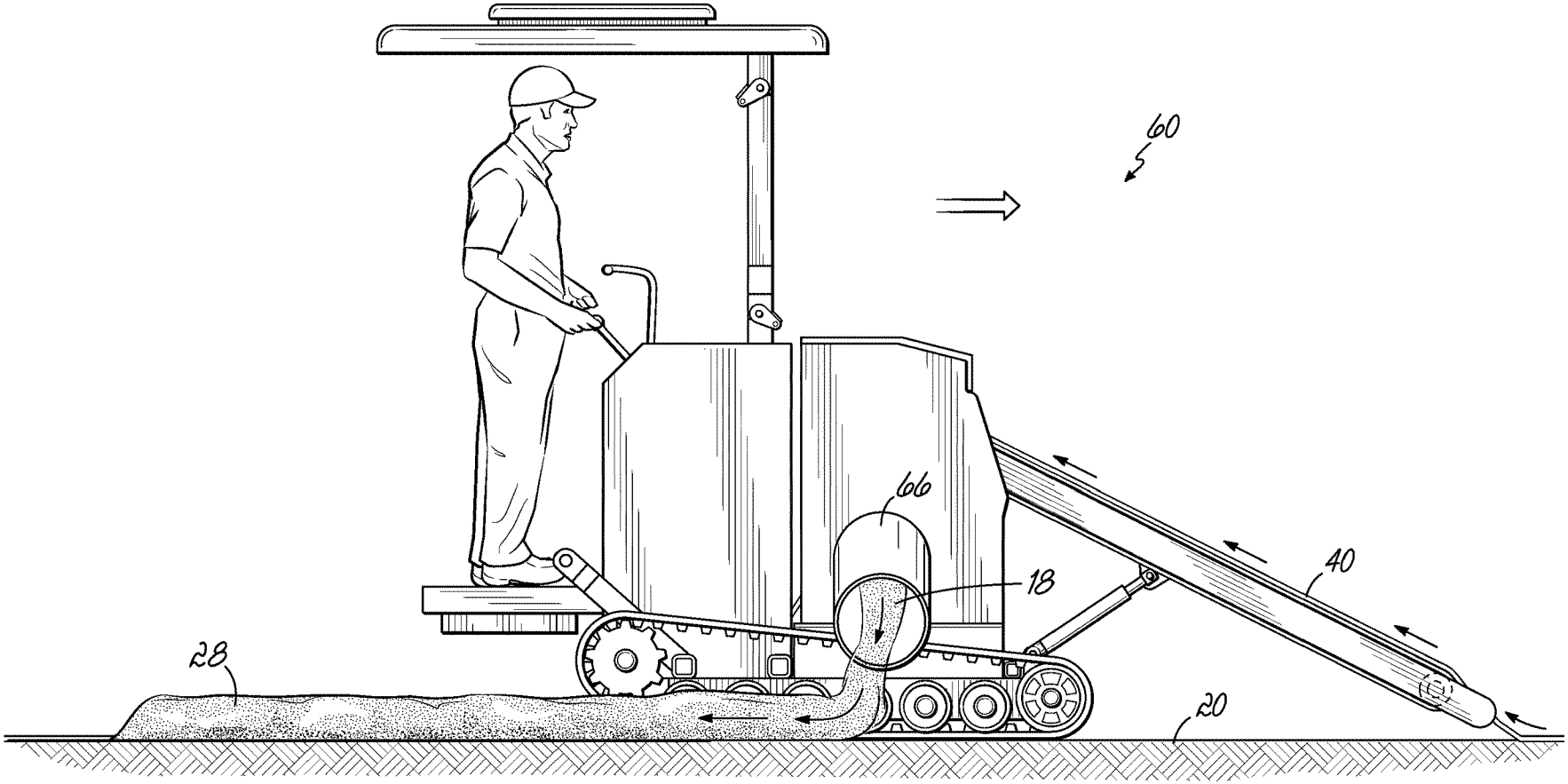
FIG. 4 is a side view of an alternative embodiment of the invention, with the bottom end of the collector auger removed and an outlet chute bolted in the same place.

FIG. 4 is a side view of an alternative embodiment of the invention, for initially depositing the extracted infill 18 on the base 20 alongside the extractor/collector device 60. More specifically, in FIG. 4 the lower end of the collector auger of the extractor/collector 60 is removed and replaced with a generally horizontally oriented auger extension chute 66. Preferably, this chute 66 is removably mounted directly to the infill extracting apparatus 60. This modified structure eliminates the need for the conveyor (or auger) and the corresponding rear cart 12. Instead, the collected infill 18 is routed outwardly from the initial collection volume to an exit point located generally above and outside of, e.g. transverse to, the tread of the vehicle 60. One advantage to this approach is that the driver of the vehicle 60 can more readily see the infill 18 being diverted onto the base 20 as it occurs.

Figure 5:
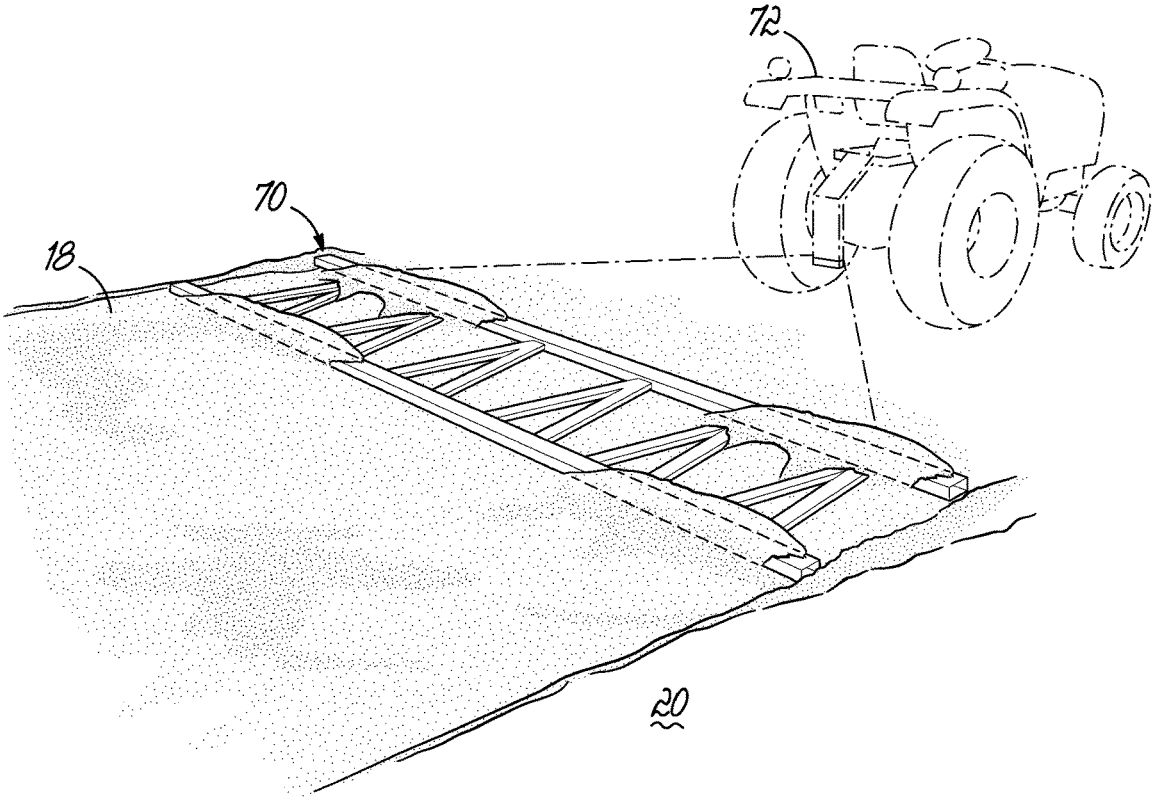
FIG. 5 is a perspective view of a spreader for distributing the deposited parallel rows of infill.

FIG. 5 shows spreading of the rows 28 of extracted and directed infill 18, via a drag mechanism 70 attached to the rear of a vehicle 72, similar to a device used to "drag" the dirt infield of a baseball field. This spreads and distributes the previously used infill 18 over the entire surface of the base 20.

Figure 6:
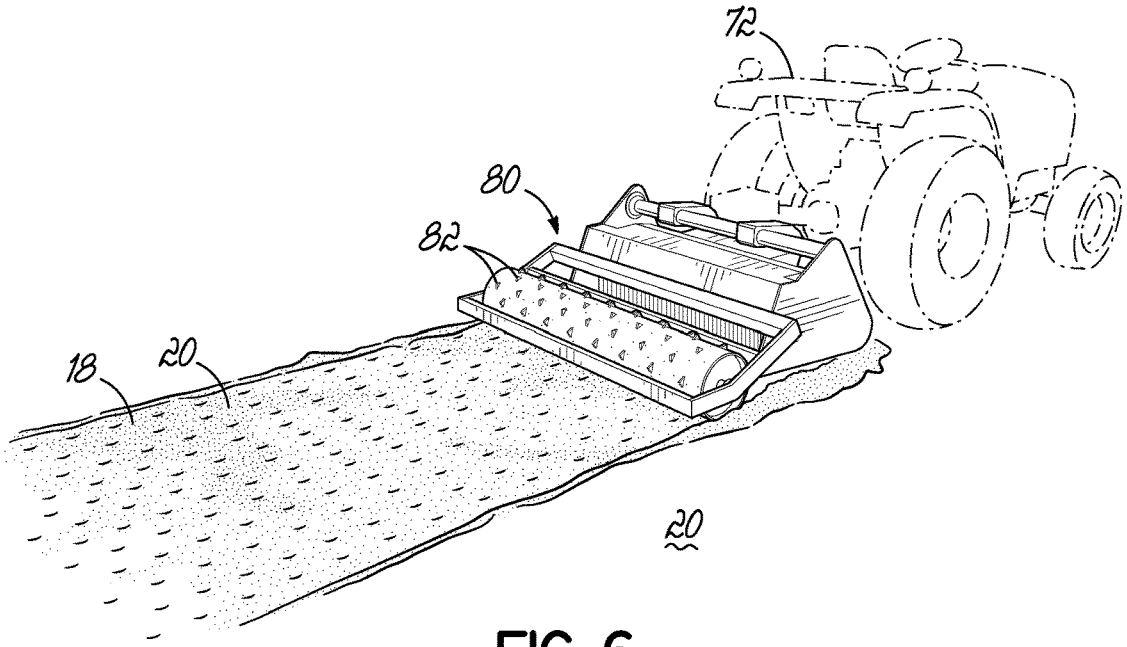
FIG. 6 is a perspective view of a device for incorporating the distributed infill into the base.
Figure 7:
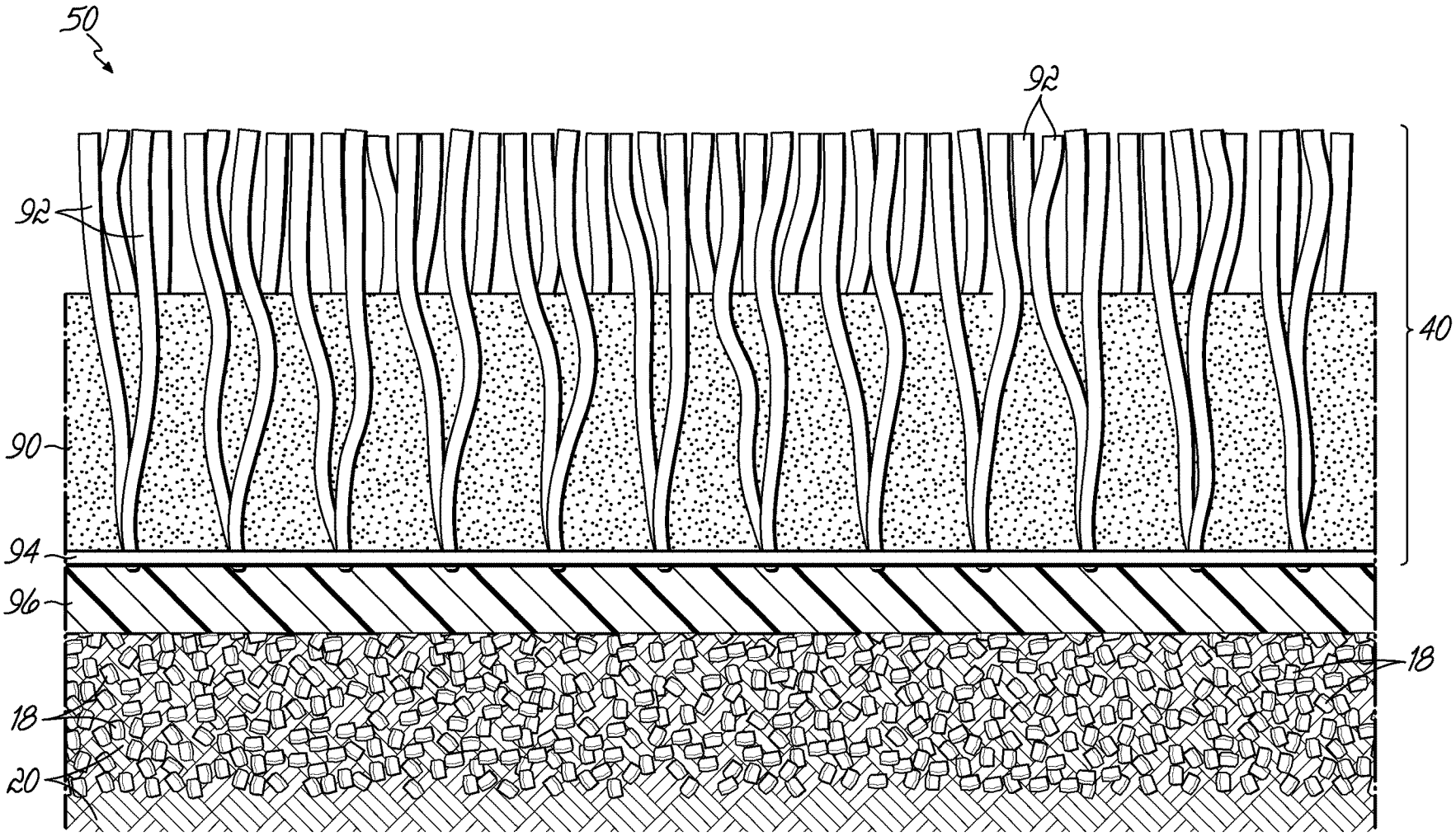
FIG. 7 is a cross sectional view of a field including a subsurface or base having repurposed infill incorporated therein, a layer of turf, and fresh infill, in accordance with an aspect of the invention.

FIG. 6 shows a device 80 known as Blecavator, which is used to till, or incorporate, the extracted and spread and distributed infill 18 into the top surface of the base 20. This Blecavator device 80 includes rotating tines 82 which dig downwardly into the compacted base 20 and pull the compacted material upward to facilitate its distribution within and among the extracted infill 18. Typically, with one to two passes of this device 80 over the surface, the extracted sand and rubber infill 18 becomes substantially uniformly incorporated into the subsurface for the field 50, along with the fines that were previously located at the top of the compacted subsurface, and the presence of this incorporated sand and rubber helps to prevent the limestone fines from crusting back together. More specifically, incorporating the infill mixture 18 of sand and rubber into the top three inches of the base 20 prevents the limestone fines from crusting back together. Once the extracted infill 18 has been sufficiently incorporated into the top of the base 20, the top surface thereof is sufficiently leveled and compacted in a manner sufficient to thereafter install a new (or previously used) turf field surface 40 on top, including one which may now make use of a new type of infill material 90, as shown in FIG. 7. For example, the new infill material 90 may be distributed among grass-like fibers 92 that are attached, i.e., as by tufting, to a primary 94 of the artificial turf component, and the primary 94 may reside on a pad 96 which in turn resides on the base 20 that has the repurposed infill 18 incorporated therein.

Thus, as described, the present invention involves a simple modification to an existing device, namely the extractor/collector disclosed in the PCT '514 application, so that that device can be used in its original, or conventional mode, to continue to collect and bag extracted infill from a worn out infilled artificial turf. Alternatively, as shown in FIGS. 1-3, the modified device 10 can redirect the extracted and collected infill 18 back onto the compacted subsurface 20, for incorporation into the upper crust thereof, so as to hinder the further compaction of limestone fines into a cement-like structure. Still further, as shown in FIG. 4, a horizontal auger extension 66 can be temporarily mounted to the side of the device 60, such as to the infill collection bin, to achieve the same result. The present invention enables vertical drainage channels to form within the top surface of the base 20 and to remain in place, primarily because the reclaimed infill 18, particularly the resilient crumb rubber particles, prevents the top surface from crusting into an impenetrable barrier within the top 1-3 inches.

To the extent that the reclaimed crumb rubber from the worn out synthetic turf has not been removed from the field site, but instead has been repurposed into a lower level of the field, within the subsurface, it still remains above the water table. In this condition it presents no greater environmental concern than it previously did, when it resided above the artificial component of the turf as the infill particulate. Moreover, relocating of the crumb rubber particles below the artificial components enables the field owner to make use of newer, more environmentally progressive infills within the artificial turf surface. Thus, the overall environment situation with respect to the water table is made no worse, while the environmental situation with respect to the infill for the artificial turf itself may have been improved.

To test this concept, applicant used three trial plots. One trial plot had an infill comprising 100% rubber. Another one used an infill with a one-to-one ratio of sand and rubber, by weight, and a third trial plot used a two-to-one ratio of sand to rubber, by weight. For each of these three trial plots, applicant mixed in fine gravel, to mimic the tilled result of incorporating an extracted infill into the uppermost surface of a base at an existing field site. Applicant then spread the three sample mixtures over coarse #57 gravel, to simulate the compacted base onto which an artificial turf is typically installed.

For each of the three sample plots, one half of the plot had a pad installed below the artificial turf, while the other half did not have a pad. Artificial turf was then installed over the entire trial area and infilled with a sand/rubber mixture. Applicant took G-Max readings (a measure of surface harness) several days later, in an effort to detect any difference resulting from variation in sand/rubber ratios, the infills, or the presence or the absence of the pad. In each case, the pad resulted in a lower G-Max rating relative to the absence of a pad, but for each of the three plots the sand rubber incorporation ratio made no difference.

Two months later, applicant again took G-Max readings of the three trial plots and again saw no differences based on infill variation. Thereafter, the artificial turf was rolled back from the no-pad halves of the samples to enable the top surfaces of the test bases to be exposed to the elements. After about six weeks, these sample no-pad half sections were analyzed for infill migration. This was done by cutting sections through the incorporation layer and into the #57 gravel layer located therebelow, to determine if any separation, i.e. any horizontal stratification, had occurred between the infill mixture and the fine gravel. No such stratification was detected. In other words, the fine gravel remained thoroughly mixed with the incorporated infill material. Applicant concluded that the infill material remained intermixed with the gravel at the top surface of the base, regardless of the sand/rubber ratio of the infill material. Applicant also concluded that the incorporated mixture minimized the likelihood of compaction over time, and that vertical infiltration rates for the resulting base would be maintained at an acceptable level.

Based on these test results, applicant believes that the present invention eliminates the need for the current field owner to dispose of between 250,000 and 750,000 pounds of extracted infill from the original field, and thereby represents a significant cost savings for the field owner. Moreover, by incorporating the extracted infill into the top surface of the compacted base, the field owner improves on the existing drainage conditions for the base located at the site of the new athletic field. For those who are responsible for removing an existing field and replacing it with a new field, the present invention simplifies that process, by eliminating the need to bag and collect all of the used and collected infill and then to move the bagged and collected infill to another site. The elimination of these steps presents a significant savings of time and cost for these tasks. Further, the present invention eliminates the need to dispose of the infill at a landfill, and thus represents a significant environmental advantage.

Those skilled in the art will understand and appreciate that this specification explains the details of the present invention in the context of several exemplary embodiments, and that those exemplary embodiments are not intended to limit the scope of the present invention, or to be used to limit the scope of the following claims. Further, those skilled in the art will also appreciate that the objects set forth in this specification are not intended to be construed as limitations. Rather, they are intended to provide the reader with a practical understanding of the various benefits achieved via certain aspects of the present invention, particularly according to the presently disclosed preferred embodiments. Also, each claim of this specification recites a combination of subject matter features that applicant considers to be new, useful, and obvious over the prior art, regardless of whether that subject matter achieves one or more of the above-described objects, or maybe even only partially achieves one or more of those objects. This specification explains the story of this invention, i.e. how it came to be, and why it represents an improvement over the existing state of the art. Applicant does not intend for this specification to be used as a roadmap by a would-be infringer to focus unduly on the above-stated objects of the invention, rather than the claims themselves. Stated alternatively, applicant does not intend that each of the appended claims is required to achieve every one of the above-stated objects, and those skilled in the art will understand that.

We claim:

1. A method of installing a new athletic field at the site of an existing infilled artificial turf field, the existing infilled artificial turf residing on a compacted base, comprising:

moving a strip of the infilled artificial turf upwardly from the base, extracting infill from the moved strip, and then placing the strip of artificial turf back on the base; and directing the extracted infill onto the base in a location that is laterally adjacent to the placed strip of artificial turf;

wherein the moving, extracting, placing, and directing occur via the use of an extractor/collector which includes an extractor portion for extracting infill from the strip and a collector portion adapted to collect extracted infill, the collector portion including a removable diverting plate operatively connected thereto, and wherein the collector portion is configured to be operable in one of two modes, a collection mode whereby the extracted infill is collected, and also in a diverting mode whereby the extracted infill is laterally directed back onto the base along a laterally located line parallel to and spaced from the path of the extractor/collector, for subsequent incorporation into the upper surface thereof, and further comprising:

using the diverting mode;

during the diverting mode, laterally directing via the diverting plate the extracted infill from the extractor/collector to a position on the base that is located alongside the replaced strip of artificial turf from which the infill has been extracted.

2. The method of claim 1, wherein the collected and extracted infill comprises at least one of the following: sand, rubber, sand/rubber mixture, coated sand, and organic particulate.

3. The method of claim 1 wherein the collector portion includes an infill collector bag that is engaged by the diverter plate, and the infill collector bag has an open bottom end, and further comprising:

causing the infill to flow through the infill collector bag in a downward direction to the base.

4. A method of installing a new athletic field at the site of an existing infilled artificial turf field, the existing infilled artificial turf residing on a compacted base, comprising:

moving a strip of the infilled artificial turf upwardly from the base, extracting infill from the moved strip, and then placing the strip of artificial turf back on the base; and directing the extracted infill onto the base in a location that is laterally adjacent to the placed strip of artificial turf;

wherein the moving, extracting, placing, and directing occur via the use of an extractor/collector which includes an extractor portion for extracting infill from the strip and a collector portion adapted to collect extracted infill, wherein the collector portion is configured to be operable in one of two modes, a collection mode whereby the extracted infill is collected, and also in a diverting mode whereby the extracted infill is laterally directed back onto the base along a laterally located line parallel to and spaced from the path of the extractor/collector, for subsequent incorporation into the upper surface thereof, wherein the extractor/collector has an infill collection bin, and an auger extension chute is removably mounted to the infill collection bin and further comprising:

using the diverting mode;

diverting the extracted infill directly from the infill collection bin to the side of the extractor/collector via the auger extension chute.

* * * * *